United States Patent [19]

Yamashita

[11] 4,424,742

[45] Jan. 10, 1984

[54] SHIFTING APPARATUS FOR A TRANSFER BAR OF A TRANSFER PRESS

[75] Inventor: Hisateru Yamashita, Komatsu, Japan

[73] Assignee: Kabushiki Kaisha Komatsu Seisakusho, Tokyo, Japan

[21] Appl. No.: 410,828

[22] Filed: Aug. 23, 1982

[30] Foreign Application Priority Data

Feb. 24, 1981 [JP] Japan ..... 56-24038

[51] Int. Cl.[3] ..... B30B 15/06

[52] U.S. Cl. ..... 100/229 R; 72/405; 72/421; 72/448; 100/918

[58] Field of Search ..... 100/918, 207, 229 R; 72/446, 448, 405, 421

[56] References Cited

U.S. PATENT DOCUMENTS

| | | | |
|---|---|---|---|
| 2,996,025 | 8/1961 | Georgeff | 72/446 |
| 3,138,978 | 6/1964 | Riemenschneider | 72/405 X |
| 3,455,141 | 7/1969 | Bracco et al. | 100/229 R X |
| 3,516,277 | 6/1970 | Bracco et al. | 100/918 X |
| 3,973,427 | 8/1976 | Shirao | 100/918 X |
| 4,012,937 | 3/1977 | Imanishi | 72/421 X |
| 4,133,199 | 1/1979 | Shirao | 72/421 X |

*Primary Examiner*—Billy J. Wilhite

*Attorney, Agent, or Firm*—Armstrong, Nikaido, Marmelstein & Kubovcik

[57] ABSTRACT

An apparatus for manually shifting a transfer bar of a transfer press between a first or advanced position and a second or retreated position. The apparatus is mounted on a moving bolster and comprises a frame and a sliding member slidable between the first and second positions and carrying a transfer bar thereon. A lever is pivotally mounted at its base end to the frame and the leading end of the lever has a roller rotatably mounted thereto. The roller is adapted to move vertically guided by a guide member mounted to the under surface of the sliding member as the lever pivots on its base end. A spring is provided for helping the movements of the transfer bar between the first and second positions.

4 Claims, 4 Drawing Figures

SHIFTING APPARATUS FOR A TRANSFER BAR OF A TRANSFER PRESS

BACKGROUND OF THE INVENTION

This invention relates to a shifting apparatus for a transfer bar of a transfer press between a first or advanced position and a second or retreated position.

Since each transfer bar of a transfer press has an extended length, it has been difficult to move in parallel both ends of each transfer bar simultaneously. In a conventional shifting apparatus, a drive shaft is provided for connecting both ends of a transfer bar and the shaft is manually rotated to move the transfer bar between a first and a second position. However, since the shifting apparatus is mounted on a moving bolster, a scrap chute and/or a drive mechanism for the moving bolster may interfere with the shaft connecting both ends of the transfer bar. Therefore in the conventional apparatus, it is difficult to find spacing for mounting such a drive shaft and the apparatus itself becomes bulky and complicated.

SUMMARY OF THE INVENTION

It is therefore an object of the present invention to provide a shifting apparatus for a transfer bar of a transfer press which is simple in construction and easy to operate.

Another object of the present invention is to provide a shifting apparatus for a transfer bar which is manually operated by merely pushing and pulling the transfer bar and requires no strong force to operate.

In accordance with an aspect of the present invention, there is provided an apparatus for shifting a transfer bar of a transfer press, comprising: a moving bolster adapted to be moved into and out of said transfer press; a frame mounted on said moving bolster; a sliding member slidable horizontally on said frame between a first and a second position; a transfer bar detachably mounted on said sliding member; lever means pivotally mounted at one end thereof to said frame, said lever means having a roller rotatably mounted thereto at the other end thereof; guide means mounted to said sliding member for guiding said roller in a vertical direction as said lever means pivotes on the one end thereof; spring means having one end mounted to said frame and the other end mounted to the other end of said lever means; and stopper means for effecting stoppage of said sliding member at said first and second positions.

In a preferred embodiment, the one end or lower end of the spring means is positioned below the one end or lower end of the lever means and both the ends are aligned on a vertical plane parallel to the transfer bar. Therefore during each stroke end of the shifting, the spring means helps move the sliding member towards first or second position, requiring no strong force to operate the apparatus. Generally, a pair of shifting apparatus are provided for a single transfer bar and since a transfer press has a pair of transfer bars, four sets of shifting apparatus are required for a single transfer press.

The above and other objects, features and advantages of the present invention will be readily apparent from the following description taken in conjunction with the accompanying drawings.

DESCRIPTION OF THE PREFERRED EMBODIMENT

The present invention will now be described in detail below with reference to the accompanying drawings.

Figure 1:
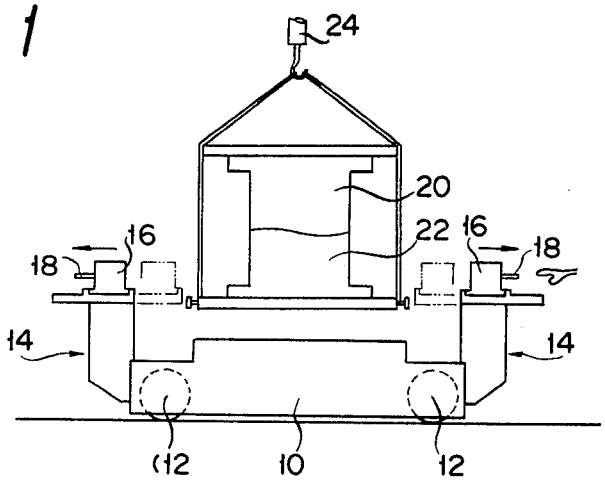
FIG. 1 is a schematic side elevational view of a moving bolster equipped with shifting apparatus for transfer bars according to the present invention showing how dies are changed.

Referring first to FIG. 1, reference numeral 10 denotes a moving bolster having wheels 12 rotatable on rails (not shown). This figure shows the moving bolster 10 stationed out of a transfer press for changing dies. Mounted to the moving bolster 10 at both end portions thereof are shifting apparatus 14 of the invention. Although FIG. 1 shows only two shifting apparatus, the moving bolster 10 has actually four shifting apparatus each pair mounted spaced apart for carrying an extended transfer bar 16. Each transfer bar 16 is detachably mounted to a pair of shifting apparatus 14 and shiftable between an advanced position shown in the dotted line and a retreated position shown in the solid line by pushing and pulling each grip 18 secured to a side face of the transfer bar 16.

For changing upper and lower dies 20 and 22, both transfer bars 16 are shifted to the retreated position by pulling the grips 18 and then both the upper and lower dies 20, 22 are hooked up by a crane 24 or the like as shown.

Figure 2:
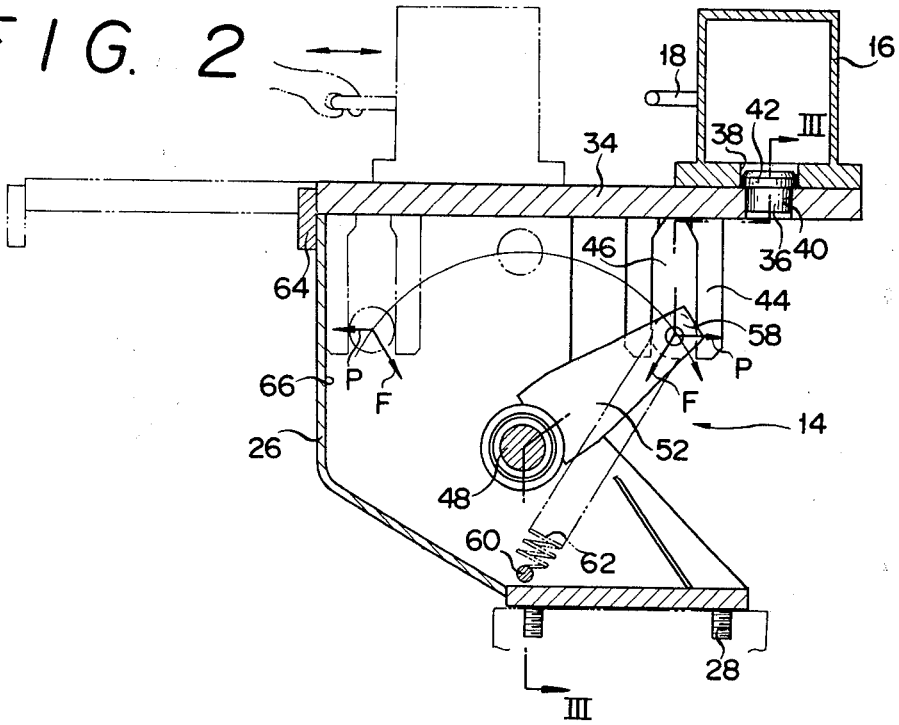
FIG. 2 is a side elevational view partly in section of a shifting apparatus according to the present invention.
Figure 3:
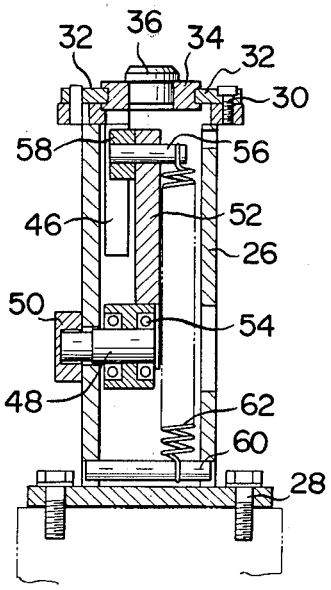
FIG. 3 is a sectional view taken along the line III—III of FIG. 2.

Referring next to FIGS. 2 and 3 showing the shifting apparatus for a transfer bar of the invention in detail, reference numeral 26 denotes a frame of the shifting apparatus 14, which is mounted to the moving bolster 10 by bolts 28. Mounted on the upper face of the frame 26 by bolts 30 are a pair of guide members 32 and a sliding member 34 is mounted between the guide members 32 and is slidable horizontally guided by the guide members 32. The transfer bar 16 is detachably mounted or placed on the sliding member 34 with a locating pin 36 inserted in holes 38 and 40 formed in the bottom wall of the transfer bar 16 and the sliding member 34, respectively. The locating pin 36 has a head 42 having a diameter smaller than that of the hole 38 but larger than that of the hole 40.

Fixedly mounted to the bottom face of the sliding member 34 are guide members 44 defining a guide groove 46 therebetween. A threaded shaft 48 is mounted to one side wall of the frame 26 by threadably engaging a nut 50 therewith. The base end of a lever 52 is rotatably mounted to the shaft 48 via a bearing 54. Rotatably mounted to the leading end of the lever 52 via a pin 56 is a roller 58 adapted to vertically slide in the guide groove 46 as the lever 52 pivotes on the shaft 48.

Mounted across both side walls of the frame 26 at a lower end portion is a pin 60 to which the lower end of a spring 62 is hooked. The upper end of the spring 62 is hooked to the pin 56. The axis of the pin 60 lies on a vertical plane passing through the axis of the shaft 48.

Mounted to the left end of the sliding member 34 is a stopper 64 for limiting the rightward movement of the sliding member 34. Leftward movement of the sliding member 34 is limited by the collision of the guide member 44 with the inner face 66 of the frame 26.

FIG. 2 shows the transfer bar 16 is in the advanced position. For die changing it is necessary to move the pair of transfer bars 16 apart from each other so as not to interfere with the dies 20, 22 being changed. For effecting this, the operator pulls the grip 18 towards left in FIG. 2. As the operator pulls the grip 18, the sliding member 34 moves towards left as well guided by the guide members 32 since the locating pin 36 engages the sliding member 34 with the transfer bar 16. Because the roller 58 is allowed to move vertically in the guide groove 46, lever 52 pivotes on the shaft 48 as the sliding member 34 moves towards left. As the roller 58 clears the top dead center and approches to the left side shifting end, the component force P of the spring force F becomes bigger. As a result, the guide member 44 is pushed against the inner face 66 of the frame 26 by the action of the component force P. Therefore only a little force is required to move the transfer bar 16 after the roller 58 clears the top dead center. When it is intended to move the transfer bar 16 towards right, it is only necessary to push the grip 18. As the sliding member 34 approches to the right side shifting end, the component force P of the spring force F becomes bigger and urges the stopper 64 to forcibly contact to the outer face of the frame 26.

Figure 4:
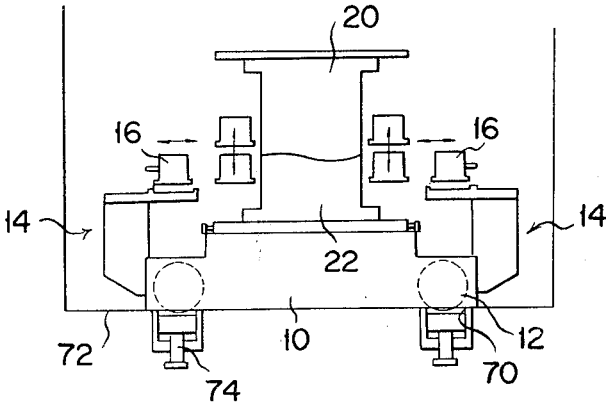
FIG. 4 is a schematic side elevational view of a moving bolster stationed within a transfer press showing how transfer bars are moved in operation.

Referring next to FIG. 4 showing the moving bolster 10 stationed within the transfer press for press operation, lower end portion of each wheel 12 is positioned in respective pits 70 allowing bottom of the moving bolster to contact to a bed 72 of the press and therefore the moving bolster 10 is held stationary for press operation.

As the moving bolster 10 is lowered to the bed, the shifting apparatus are lowered as well allowing each locating pin 36 to be taken out of the hole 38. Therefore, transfer bars 16 can be moved by feed mechanism (not shown) as shown by arrows in FIG. 4 for feeding workpieces in the press. When it is desired to move the moving bolster 10 out of the press for die changing, jacks 74 are actuated to lift the wheels 12 so that the bottom of each wheel 12 levels with the press bed and then a driving means (not shown) of the moving bolster 10 is actuated to move the same out of the press.

What is claimed is:

1. An apparatus for shifting a transfer bar of a transfer press, comprising;

a moving bolster adapted to be moved into and out of said transfer press;

a frame mounted on said moving bolster;

a sliding member slidable horizontally on said frame between a first and a second position;

a transfer bar detachably mounted on said sliding member;

lever means pivotally mounted at one end thereof to said frame, said lever means having a roller rotatably mounted thereto at the other end thereof;

guide means mounted to said sliding member for guiding said roller in a vertical direction as said lever means pivotes on the one end thereof;

spring means having one end mounted to said frame and the other end mounted to the other end of said lever means; and stopper means for effecting stoppage of said sliding member at said first and second positions.

2. An apparatus as recited in claim 1 wherein the one end of said spring means is positioned below the one end of said lever means.

3. An apparatus as recited in claim 2 wherein the one end of said lever means and the one end of said spring means are positioned on a common vertical plane parallel to said transfer bar.

4. An apparatus as recited in claim 1, 2 or 3 wherein said transfer bar has a grip fixedly secured thereto.

* * * * *